United States Patent [19]

Bartlett

[11] Patent Number: 4,466,349

[45] Date of Patent: Aug. 21, 1984

[54] CYLINDER CONSTRUCTION FOR A PRINTING PRESS

[76] Inventor: Norman C. Bartlett, 202-64 Soundview Ave., Stamford, Conn. 06902

[21] Appl. No.: 332,465

[22] Filed: Dec. 21, 1981

[51] Int. Cl.[3] ..... B41F 5/04

[52] U.S. Cl. ..... 101/220; 101/415.1

[58] Field of Search ..... 101/220, 229, 382 R, 101/415.1, 348–350, 178–179, 378, 384, 221, 275, 231, 246

[56] References Cited

U.S. PATENT DOCUMENTS

| | | | |
|---|---|---|---|
| 1,773,949 | 8/1930 | Casto | 101/415.1 |
| 3,166,012 | 1/1965 | Hantscho | 101/229 X |
| 3,844,214 | 10/1974 | Smith | 101/415.1 |

*Primary Examiner*—E. H. Eickholt

[57] ABSTRACT

A cylinder for a printing press in which the gap for receiving the ends of a plate or blanket is skewed at an angle with respect to an axial length on the surface of such cylinder such that streaking of the printed product as is visible to the human eye is essentially eliminated. Such improved cylinders have a linear skew width greater than the linear gap width with the trailing end of the trailing edge of the gap being located opposite a non-gap area of the other of such cylinders cooperable therewith when such gaps are in their full overlying position. Such improved cylinders have a non-rotative relative motion when the gaps cross over each other such that the cylinders gradually enter into a zone of decreased pressure therebetween and gradually exit from such zone whereby axial deflection of the cylinders is minimized. Such improved cylinder is particularly suited for a blanket cylinder, a pair of blanket cylinders or plate cylinders or the well known combinations of blanket and plate cylinders. Further, since the gaps are skewed, a plate or blanket in the form of a parallelogram is provided to improve the mounting of such a plate or blanket to a cylinder having a skewed gap of this invention.

11 Claims, 9 Drawing Figures

CYLINDER CONSTRUCTION FOR A PRINTING PRESS

BACKGROUND OF THE INVENTION

In the printing industry one long existing problem has been the problem of "streaking" in the printed product. One commonly held belief is that streaking is caused by the variation in pressure between a cooperable pair of plate and blanket cylinders as the gaps in the outer surfaces of the plate and blanket cylinders come into registry with each other. The prior art has extensively reviewed the streaking problem such that a repetitious detailed description thereof is not warranted for an understanding of the present invention to one skilled in the relevant art. However, the prior art is informative in that it emphasizes not only the streaking problem, but also sets forth many of the factors which can cause streaking such as the speed of a printing press, the configuration of the cylinders of a printing press, cylinder mounting, the bearing supports for the cooperable plate and blanket cylinders, etc. U.S. Pat. No 3,395,638 is of interest as a non-circular blanket or impression cylinder is described having a relief area 50 of a width w to provide a force characteristic (FIGS. 3*a* and 3*b*) whereby vibration of the cylinders is reduced. This patent also describes the effects of the sudden application and release of an impression force, and comments upon the complications of critical speed resonance, printing press speed, the gap or gutter on the cylinders, and non-printed margin. U.S. Pat. No. 3,166,012 is of interest in that a skewed gap is defined to maintain an uninterrupted compression gripping pressure on a web passing through a pair of cooperable blanket cylinders. In such patent the skew angle is quite small, illustratively 0.3 degrees on a 36 inch blanket. In obtaining such minimum angle the stated governing relationship is that the skew "advance" or arc B (FIG. 3) shall be significantly greater than the gap width minus the width of the narrow zone of tangency T. Thus, for a minimum skew angle, as desired, the skew advance is always less than the gap width. See for example the illustrative numerals set forth in the patent. U.S. Pat. No. 4,125,073 also sets forth the streaking problem with reference to the gap or gutter and cylinder vibration. This patent also comments upon the degradation of oscillatory cylinder movement, blanket resilience, lack of ink transfer and the relative oscillations of the plate and blanket cylinders. In such patent a mechanical damping mechanism is disposed in one or more cylinders to reduce cylinder oscillation. This patent further illustrates the well known nature of mechanical damping means for minimizing cylinder oscillation. U.S. Pat. No. 4,149,461 describes a cam and cam follower structure to prevent objectionable streaking.

Still other aspects of the prior art are shown in U.S. Pat. Nos. 3,256,812—re bearer rings; 3,177,804—re positive guiding; 3,589,285—re controlled yieldable portion; 2,986,085—re offset or displaced gaps, and 2,812,134—re blanket seam and margin. In addition the prior art disclosed and/or discussed in the above patents should be examined to obtain a complete understanding of the streaking problem.

SUMMARY AND OBJECTS OF THE INVENTION

The present invention is to the construction of a plate or blanket cylinder having a gap extending at an angle with respect to an axial line on the outer surface of the cylinder to provide a skew width which is greater than the width of the gap. With such a structure for a pair of cooperable cylinders as described herein the ends of the leading edges of the cylinder gaps are located opposite a non-gap area when the cylinder gaps are in their full overlying position. In particular the trailing end of the leading edge of the gap in each cylinder is located opposite a non-gap area when the cylinder gaps are in their full overlying position. Further, the skew width plus the gap width is no greater than the allowable or permissible non-print margin. With such a skewed gap the blanket or plate to be secured to the cooperable cylinders is preferably in the form of a non-rectangular parallelogram to facilitate securing the blanket or plate to a cylinder.

With the invention of this application there is a marked decrease in streaking. It appears that this results from two factors. To begin with, a major contributor to streaking is the sudden movement of the rolls toward each other as their respective gaps come into register with each other. At that time, the effective pressure between the rolls is reduced and the rolls suddenly accelerate toward each other under the forces that urge them together. This effective impulse causes a "ringing", i.e., a decaying resonant vibration of the rolls and that is the immediate cause of streaking. With this invention, the gaps on opposing rolls do not register, but rather, because of the skew they intersect each other. As a result, the area of overlap increases gradually from zero to a maximum and then gradually decreases to zero. Thus, the impulse imparted to the rolls is substantially stretched in time and it consequently is much less effective as a cause of ringing. Moreover, to the extent that the skew width exceeds the gap width, the axial length of the region of maximum gap overlap is decreased, i.e., confined to the central portions of the rolls. This effectively shortens the portions of the rolls subject to bending in the overlap region. The rolls are thus stiffened and their displacement toward each other is reduced, thereby reducing the amplitude of the impulse imparted to them and again reducing the ringing effect.

Accordingly, one object of this invention is to provide a new and improved printing apparatus in which the rotating cylinders do not produce an objectionable streaking in the printed product.

The principal object of this invention is to increase the speed of a printing press without encountering objectionable streaking. An equivalent object is to reduce the degree of streaking for a given speed.

Another object is to provide a printing plate and a blanket for use in a printing press bearing the foregoing characteristic.

Another object of this invention is to provide a new and improved cylinder for a printing press which cylinder has an axially skewed gap therein for receiving a blanket, plate or the like therein with the skew width being equal to or greater than the width of the gap.

Another object of this invention is to provide a new and improved cylinder for a printing press which cylinder has an axially skewed gap therein for receiving a blanket, plate or the like therein with the skew width being greater than the gap width and with the skew width plus the gap width being no greater than the length of the allowable non-print margin.

Another object of this invention is to provide the blanket cylinders of a printing press with blanket gaps extending at an angle with respect to an axial length on the outer surface of the cylinders which blanket gaps are of a structure to eliminate any objectionable streaking on a web of paper passing therebetween.

A specific object of this invention is to provide a new and improved blanket or plate for a printing press which is in the form of a non-rectangular parallelogram.

Another object of this invention is to provide a printing press in which the blanket cylinder has a skewed gap therein in which the skew width is equal to or greater than the gap width.

A still further object of this invention is to provide a printing press in which the blanket and plate cylinders each have a skewed gap therein with each of such gaps having a skew width greater than the gap width.

Other objects will in part be obvious and will in part appear hereinafter.

The foregoing objects have been accomplished by providing a skew width at least as great as the width of the gap. The skew width is essentially the same as the skew "advance", the difference being the difference between an arc length (advance) and the corresponding chord (width). This difference is negligible in terms of the angles involved here. Moreover, in contrast with the prior U.S. Pat. No. 3,166,012, the skew width is preferably as large as possible compared to the gap width with the upper limit of the skew and gap widths being imposed by the size of the non-print margin. Specifically, skew width plus the gap width will be no greater than the allowable or permissible non-print margin.

These and other objects of this invention will be better understood in view of the following description and drawings of the presently preferred embodiment of the invention in which.

Figure 1:
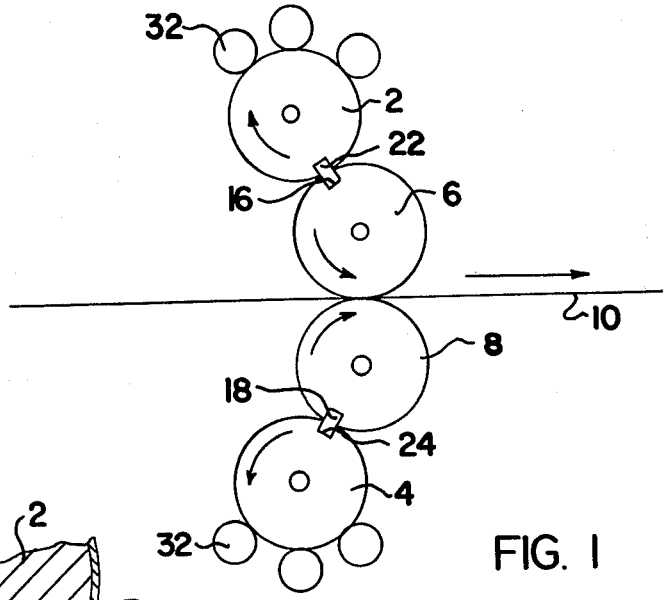
FIG. 1 is a diagrammatic illustration of the cylinders of a multiple cylinder printing press in which cylinders constructed in accordance with the principles of this invention are used and which illustrates in disproportionate scale the gaps of the plate cylinders in their full overlap position.

As is well understood in the art of offset printing (FIGS. 1 and 2), ink images are transferred from upper and lower type or plate cylinders 2, 4 to upper and lower impression or blanket cylinders 6, 8, respectively, which, in turn, transfer the images to the top and bottom surfaces of a paper web 10 passing between the blanket cylinders 6, 8. Suitable blankets 12, 14 usually of rubber, are circumferentially wrapped around the outer surfaces of cylinders 6, 8, respectively, with the free ends of the blankets extending inwardly of cylinders 6, 8 through slots 16, 18 in cylinders 6, 8, respectively. As is well known, such opposed cylinders 6, 8 with blankets 12, 14 form a nip therebetween for printing on opposite sides of paper web 10. As hereinafter described the widths of slots 16 and 18 are within certain dimensional limits and for such purposes the ends of blankets 12, 14 are of a size to permit their insertion within the slots 16, 18 as shown. Cylinders 6, 8 suitably support suitable blanket clamping or lock up devices 20 whereby the blankets 12, 14 are suitably retained on cylinders 6, 8, respectively. The clamping device 20 is of any suitable structure. Prior clamping devices are well known and further description thereof is not necessary for an understanding of this invention by one skilled in the relevant art; however, for additional information on such devices see U.S. Pat. Nos. 4,068,586; 4,122,774; 4,217,825 and 2,279,204 and the prior art cited and identified therein. As is also well known suitable type plates 3, 5 are circumferentially wrapped around the outer surfaces of cylinders 2, 4, respectively, with the free ends thereof extending inwardly of cylinders 2, 4 through slots 22, 24, respectively. Cylinders 2 4 suitably support suitable plate clamping devices (not shown) whereby the plates 3, 5 are suitably retained on the cylinders 2, 4.

Figure 4:
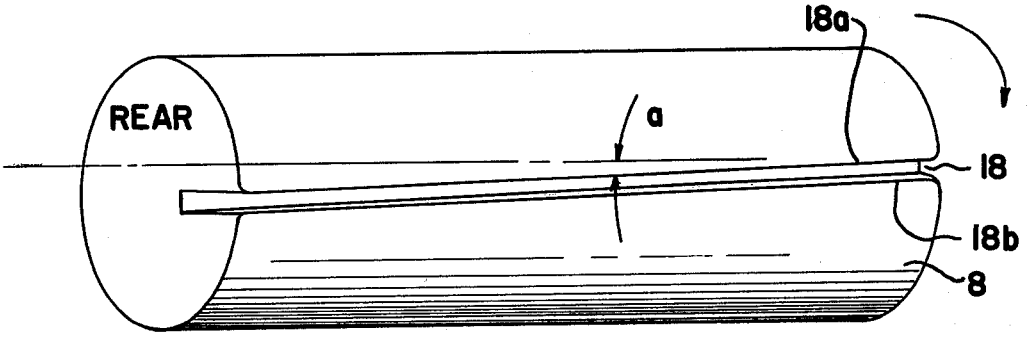
FIG. 4 is a simplified perspective view of a blanket cylinder constructed in accordance with the principles of this invention.
Figure 5:
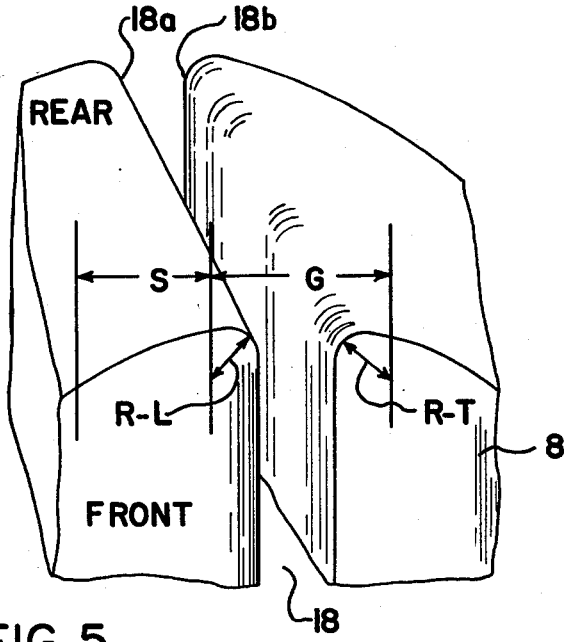
FIG. 5 is a perspective view of the gap portion of the cylinder as shown in FIG. 4.

FIGS. 4 and 5 illustrate a blanket cylinder of this invention prior to the installation of a blanket thereon and with the clamping device 20 omitted. With the direction of cylinder rotation shown by the arrow in FIG. 4 the lower blanket cylinder 8 is shown in FIGS. 4 and 5 for a web 10 traveling from left to right with reference to FIGS. 1 and 2. Slot 18 is an open ended slot which extends throughout the length of cylinder 8 with the ends of slot 18 being circumferentially offset with respect to each other on the outer surface of cylinder 8—it being understood that a longitudinal axis on the outer surface of the cylinder refers to an axis parallel to the central rotative axis of the cylinder 8. Alternatively expressed, the slot 18 is axially skewed with respect to a longitudinal axis on the outer surface of cylinder 8 with the angle a of skew being uniform throughout the length of cylinder 8.

In forming slot 18 the junctures between the outer ends of the sides of slot 18 and the outer surface of cylinder 8 are radiused to permit the blanket 14 to extend thereover in taut relationship without being damaged during installation or operation. Cylinder 8 rotates, as shown, in a clockwise direction with the leading edge 18*a* of slot 18 being radiused on a radius R-L, illustratively at 0.025", and the trailing edge 18*b* being radiused on a radius R-T, illustratively at 0.030". Radii R-L and R-T are blend radii which are selected to permit blanket 14 (FIG. 2) to be stretched thereover in a known manner. The point at which radius R-L blends with the outer surface of cylinder 8 throughout the length of cylinder 8 defines the leading edge of cylinder 8. Similarly such blend point throughout the surface of cylinder 8 by radius R-T defines the trailing edge of cylinder 8. Thus, as the blanket cylinder 8 rotates, a reduced pressure zone with respect to web 10 occurs between the trailing and leading edges of cylinder 8 since the blanket 14 is not supported by the outer surface of cylinder 8 in the gap G between the trailing and leading edges. The total or effective width of gap G of cylinder 8 is a linear distance between the trailing and leading edges which is equal to the sum of radius R-L, the width of slot 18 extending between opposed ends of radii R-L and R-T inwardly of cylinder 8, and radius R-T. Thus for a slot width of 0.170" the total width of gap G for cylinder 8 is 0.025"+0.170"+0.030" for a total gap G width of 0.225". Such gap g is the linear distance throughout which the pressure between cylinders is partially relieved with respect to the web 10.

Gap G is constant throughout the length of cylinder 8; however, since the gap G is skewed, the total non-print area of cylinder 8 is equal to the width of gap G plus the displacement length of the gap G resulting from the circumferential offset, displacement or skew of slot 18. Since the configuration of the cylinder 8 is symmetrical throughout the length of the slot 18, the skew width S is measurable at numerous locations and, as shown (FIG. 5), one measurement is by the linear offset of the center of radius R-L when measured on one end of the cylinder 8. For convenience in description FIG. 5 identifies the end or surface of the cylinder 8 facing the observer as the front and the end or surface of cylinder 8 away from the observer as the rear. Skew S in FIG. 5 is measured in the plane of the front surface of cylinder 8 and is a linear dimension equal to the distance between the center of radius R-L on the front and rear surfaces with the center on the rear surface being projected to the front surface to provide a linear dimension with respect to the front surface. The skew S of the cylinder 8 shown is 0.250". Thus, the effective length of the non-print area or waste length of the blanket cylinder 14 is the sum of the width of the gap G (0.225") and the width of the skew S (0.250") or 0.475".

In normal practice the plate cylinders 2, 4 are circumferentially encompassed by the printing plates 3, 5, respectively, with the ends thereof extending into the interior of cylinders 2, 4 through slots 22, 24 in cylinders 2, 4, respectively. For the purposes of this invention it is sufficient to understand that slots 22, 24 extend axially of cylinders 2, 4, respectively, in most existing presses having such plate cylinders. The skewed gap blanket cylinder of this invention is utilized with such existing plate cylinders to essentially eliminate the streaking problem as is observable by the human eye. It will be appreciated that the width of gap G and skew S will vary with the various sizes of plate cylinders on various printing presses. The blanket cylinder described and shown herein is for use with a plate cylinder in which the plate cylinder slot 22 or 24 has a total width not greater than the length of the non-print area of the blanket cylinders 6 or 8 when the circumferential register is included as set forth in more detail hereinafter.

The plate and blanket cylinders with the printing plates and blankets attached thereto are essentially of the same diameter both above and below the web 10 so that all the cylinders rotate at the same rpm and the blanket cylinders 6, 8 travel at the same speed while in engagement with opposite sides of the web 10. Further, since it is the purpose to transfer the images on the printing plates to the blankets, each cooperable pair of plate and blanket cylinders is aligned in circumferential registry to obtain the proper circumferential positioning of the image from the printing plate on the blanket as is required by the web 10. In actual practice it is well known to provide for adjusting the blanket cylinder circumferentially plus or minus ⅛ of an inch to obtain multi-color register on the web 10. Such circumferential register can also be obtained by adjusting the plate cylinder circumferentially with respect to the blanket cylinder cooperable therewith.

Figure 2:
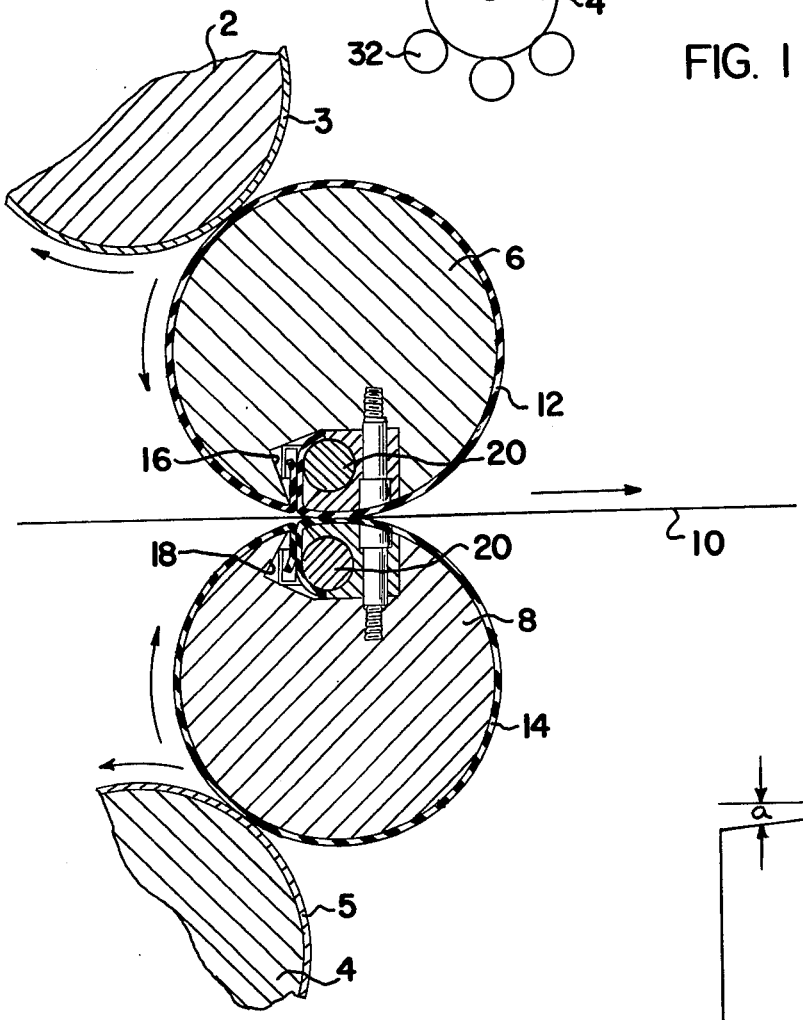
FIG. 2 is a cross-sectional view of the blanket cylinders and a portion of the plate cylinders as shown in FIG. 1.

With the cylinder arrangement as shown in FIG. 1 the reversed (as hereinafter described) skewed gaps in the blanket cylinders 6, 8 are of opposite hand and have two crossover periods—one as shown in FIG. 2 when the gaps of blankets 12, 14 cross over each other and the second as shown in FIG. 1 when the gaps of the blankets 12, 14 cross over the gaps in the plates carried by the plate cylinders 2, 4, respectively. The crossover of the blanket gaps with the printing plate gaps is known as the timing position and the cooperable blankets and plates are circumferentially adjusted so that the non-print area of each blanket cylinder coincides and is, therefore, not additive which would increase the non-print area. The pressure between cylinders is identified as "squeeze" which is controllable by adjusting the relative position of the cylinders transversely of their rotative axes. A squeeze of 0.004" to 0.006" is commonly used between cooperable plate and blanket cylinders and a squeeze of 0.006" to 0.010" is commonly used between cooperable blanket cylinders. As is known, the blanket to blanket squeeze is always greater than the plate to blanket cylinder squeeze. With such higher blanket to blanket squeeze the crossover of the blanket gaps has a higher capability to vibrate the blanket cylinders than the crossover of the blanket and plate cylinders. Consequently the more severe crossover conditions are described herein to obtain the best understanding of the invention.

The upper blanket cylinder 6 is identical to lower blanket cylinder 8 with the important exception that in operation the cylinders 6 and 8 rotate in opposite directions. With such reversal of the skewed gaps G of cylinders 6, 8 the reversed or opposite hand gaps G form, at the midpoint of their relative crossover travel, an X pattern as shown in FIGS. 8 and 9 which is selectable within limits as hereinafter described.

As heretofore stated, with this invention the width of skew S is greater than the total or total effective width of gap G and, accordingly, in the midpoint of the crossover position of the blanket cylinders 6, 8 the leading and trailing ends of the gaps G are circumferentially (with respect to the outer surfaces of the blanket cylinders) spaced from each other albeit on different cylinders. Thus FIGS. 8 and 9 schematically represent an overlay of gaps G on the cylinders 6, 8 in a mid crossover position. It is to be noted that, in fact, the outer cylindrical surfaces of cylinders 6, 8 are separated by the web 10 and travel about spaced parallel rotative axes. FIG. 8 illustrates the minimum width of skew S according to this invention as being equal to the width of gap G in which the trailing end of the trailing edge of the gap G in the lower cylinder 8 is in underlying alignment with the outer surface of cylinder 6 at the leading end of the leading edge of the gap G in the upper cylinder 6. Simultaneously the trailing end of the trailing edge of the cylinder 6 is just in overlying alignment with the outer surface of cylinder 8 at the leading end of the leading edge of the gap G in the lower cylinder 8. Inasmuch as the skew width can equal the gap width, for the purposes of this invention, FIG. 8 shows the ends of the leading edges with respect to the ends of the trailing edges as coincident. FIG. 9 shows the trailing ends of the trailing edges of the blanket cylinder gaps being circumferentially spaced from the leading ends of the leading edges in which the skew width is increased substantially over the gap width so that the trailing ends of the trailing edges are spaced from the leading ends of the leading edges. Such spacing is in fact a circumferential distance on the outer surfaces of the cylinders 6, 8 which is shown as a projected spacing of a distance D between the gaps G in the planar representation of FIG. 9.

Figure 8:
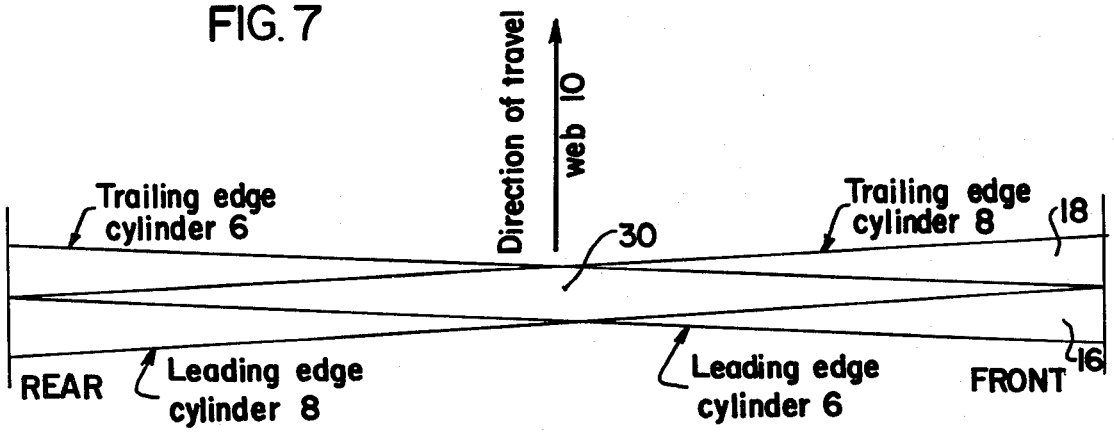
FIG. 8 is a planar representation of a pair of opposed gaps in cylinders constructed in accordance with the principles of this invention with such gaps being at their full overlying position.
Figure 9:
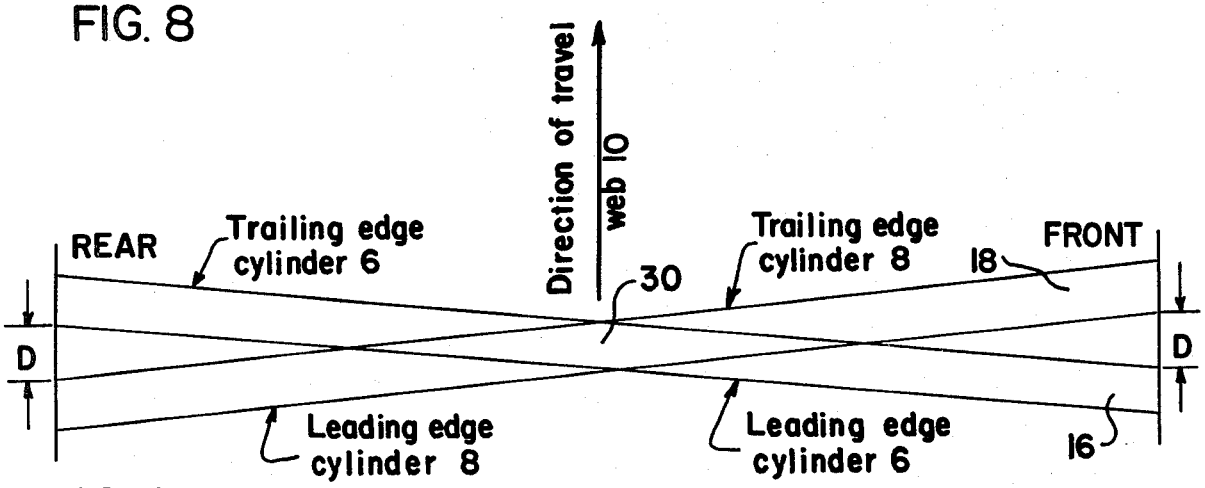
FIG. 9 is a planar representation of a pair of opposed gaps in cylinders similar to FIG. 8 in which the skew width is larger than the skew width shown in FIG. 8.

FIGS. 8 and 9 illustrate the planar projection of the open crossover area zone 30 that exists when the cylinders 6, 8 are in the midpoint of crossover. With the width of skew S equal to the width of gap G (FIG. 8) zone 30 is in the form of an elongated diamond with the opposite axially located apexes lying in the planes of the ends of the cylinders 6, 8, i.e., the front and rear ends of the cylinders. FIG. 9 illustrates that as the width of skew S increases beyond the width of gap G the zone 30 decreases in area in that the axial apexes of zone 30 move axially inwardly away from the front and rear surfaces of the cylinders 6, 8. The linear width of zone 30 (i.e., in the direction of web travel) is equal to the effective width of gap G and remains the same as the width of skew S varies. From the standpoint of the skew width being greater than the gap width, distance D can be increased from that shown in FIG. 9 by increasing the skew angles of the blanket cylinders and decreased by decreasing the skew angles.

As stated, FIGS. 8 and 9 depict the midpoint of gap crossover. In fact as the edge of the gap G on one blanket cylinder starts to overlie the edge of the gap G of the other blanket cylinder the formation of zone 30 between the blanket cylinders is initiated. Initially zone 30 will start as a point from the intersection of the trailing edges at the midpoint of the cylinders 6, 8 which, as the cylinders rotate, becomes a small triangular area which will increase in area as an increasing series of triangular areas until the midpoint crossover position is achieved and thereafter zone 30 will decrease in area as a series of decreasing area triangular areas. The maximum distance for distance D is established by the acceptable length of web 10 which is not printed upon; such non-printing length across the paper width constituting a margin in which no printing occurs. The maximum margin length has been established by past industry standards as less than ½" in length in order to obtain 22¼" of printing on a press having a 22¾" circumference. With such maximum margin length of ½" and the width of gap G as heretofore described, the circumferential registry between plate and blanket cylinders is only obtainable by rotating the plate cylinder relative to the blanket cylinder. Thus, for the purposes of this invention the skew width can vary from being equal to the effective width of gap G to the maximum acceptable to the industry with respect to margin length. Such maximum margin length is determined by the distance between the leading end of the trailing edge and the trailing end of the leading edge of the gap G when the gaps G are in the middle of their crossover position, i.e., the skew width plus the gap width.

Specifically, as the cylinders 6, 8 rotate with the gaps G thereof about to enter into registry, the trailing edges of cylinders 6, 8 at the axial midpoint M of the cylinders will initially overlie each other in a point relationship with reference to a plane P defined by the rotation axis of both of the cylinders 6, 8. As cylinders 6, 8 continue to rotate the portions of the trailing edges spaced from the midpoint M on plane P become further axially spaced from each other so that in plane P the axially extending length of zone 30 gradually increases from such initial point to the full axial length of the zone 30 at the midpoint of crossover. Also, at the midpoint of crossover, the leading edges of the cylinders 6, 8 start to overlie each other in plane P. Continued rotation of cylinders 6, 8 past the midpoint of crossover moves the trailing edges out of overlying relationship in plane P; however, the portions of the leading edges spaced from the midpoint of cylinders 6, 8 continue to be in overlying relationship in plane P so that the axial length of zone 30 in plane P decreases from the midpoint of crossover until such time as the overlying intersection of the leading edges in plane P becomes a point. Thus, zone 30 in plane P starts as a point formed by the trailing edges, becomes a constantly increasing axial length between the trailing edges until the midpoint of the crossover is reached and, after the midpoint of crossover, becomes a constantly decreasing axial length between the leading edges until the leading edges become a point. Alternatively stated with respect to the representation of overlying projections, as cylinders 6, 8 rotate the zone 30 starts as a point from the overlying intersection of the trailing edges, becomes a series of triangular areas (herein referred to as trailing edge triangles) all having an apex at the midpoint of the cylinders 6, 8, but which are of increasing area since the axial spacing of the trailing edges increases during cylinder rotation until the midpoint of crossover is reached (FIGS. 8, 9). At the midpoint of crossover the leading edges of cylinders 6, 8 are also in overlying relationship and spaced axially the same distance as the trailing edges are spaced axially, i.e., the outer ends of the diamond shaped zone 30. As rotation continues the leading edges form a series of triangular areas (herein referred to as leading edge triangles) of decreasing area with all of such decreasing areas having an apex at the midpoint of the cylinders 6, 8. Thus, FIGS. 8, 9 depict the maximum area of trailing edge and leading edge triangles at the midpoint of crossover in which the maximum axial length of zone 30 is established by the angle of skew, i.e., the larger the skew angle or skew width the smaller the maximum length of zone 30. Thus as the cylinders 6, 8 rotate into gap crossover the area of the reduced pressure zone 30 between the cylinders gradually increases to the midpoint of crossover and thereafter gradually decreases until crossover is completed. In addition, the area of zone 30 increases and decreases uniformly on each side of the midpoint of cylinders 6, 8 so that the cylinders 6, 8 are axially balanced with respect to forces between the web 10 and the cylinders 6, 8 as may result from the changes in the area of zone 30.

Figure 6:
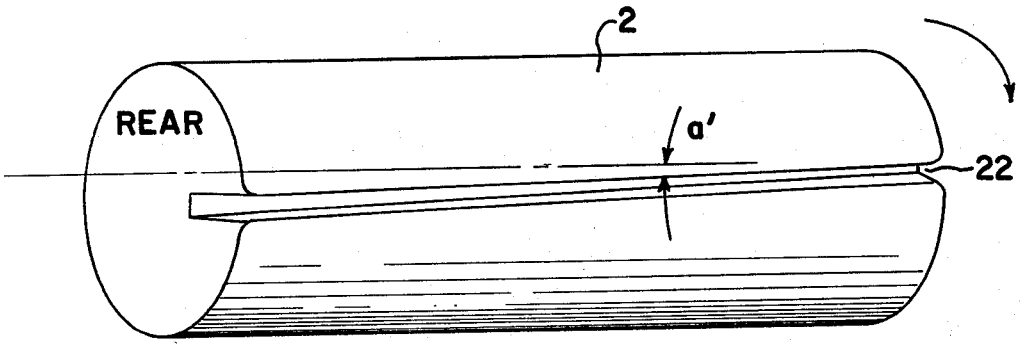
FIG. 6 is a simplified perspective view of a plate cylinder constructed in accordance with the principles of this invention.
Figure 7:
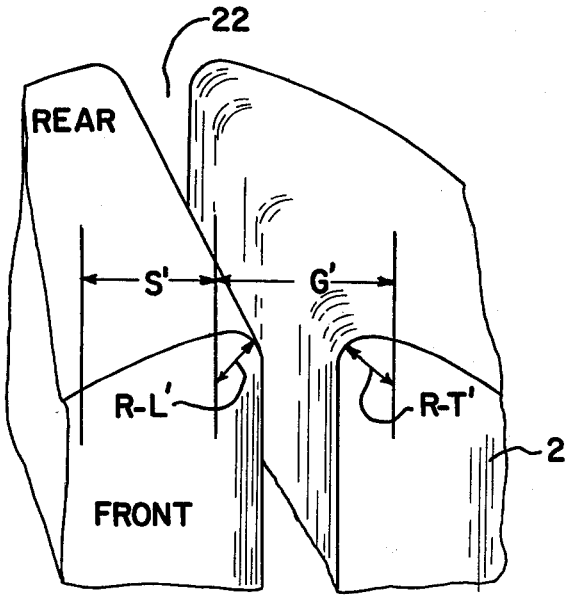
FIG. 7 is a perspective view of the gap portion of the cylinder as shown in FIG. 6.

The skewed gap blanket cylinders 6, 8 have a principal use with plate cylinders having axially extending gaps; however, a skewed gap plate cylinder is the contemplated preferred structure. In this regard, skewed gap plate cylinders are not essential to obtain the benefit of the skewed gap blanket cylinders 6, 8 as heretofore described nor is it necessary that the effective gap width of the plate cylinder, FIG. 7, be smaller than the skew width to obtain the benefit of the skewed gap blanket cylinder 6, 8 as heretofore described. Preferably the skew width of the plate cylinders is larger than the effective gap width of the plate cylinders to obtain the maximum reduction in the dynamic deflection of the plate cylinders 2, 4. Thus, as shown in FIGS. 6 and 7 a plate cylinder, the upper plate cylinder 2 being shown, is essentially identical to the blanket cylinder previously described; however, the dimensions of the plate cylinders are different from the dimensions of the blanket cylinders. For convenience, the plate cylinder 2 of FIGS. 6 and 7 is identified with the same letters primed as heretofore employed with respect to the blanket cylinder 8. The effective gap G' of the plate cylinder 2 has a width equal to the sum of radius R-L', the width of slot S' and radius R-T'. Further the slot S' is skewed a linear distance, as heretofore explained, greater than the effective width of gap G'.

With the illustrative dimensions for the cylinder 2 the effective width of the gap G' is 0.062"+0.062"+0.031" or 0.155". A skew width of 0.160" is provided to obtain a skew width greater than the effective gap width. Such dimensions provide a minimum margin length of 0.315" (0.155"+0.160"). With the plate cylinder having to be adjustable for circumferential registry and with a maximum margin length of a nominal ½" (say 0.475") in the example of FIG. 7, the total circumferential adjustment of the plate cylinder is 0.160" (0.475"–0.315") or 0.080" (0.160"÷2) in either circumferential direction. Such a skewed gap plate cylinder is particularly desired since the known rubber form rollers 32 cooperable with the plate cylinders 2, 4 will not have as large an open zone during crossover for permitting movement of the rollers 32 towards the plate cylinders. Should the + or −⅛" circumferential registry of the plate cylinder be required in particular instance then, since the 0.062" slot is a reasonable minimum for practical purposes, the skew width of 0.160" would have to be—as an approximation say to 0.070". Although such reduced skew is not as desired as that previously described it is satisfactory for use with the skewed gap blanket cylinders as previously described.

Figure 3:
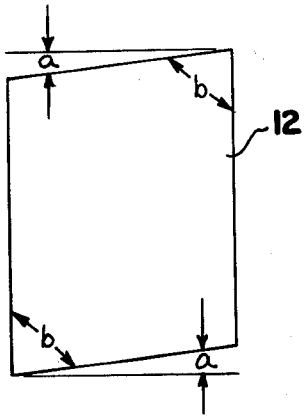
FIG. 3 is a plan view of a plate or blanket as constructed in the form of a non-rectangular parallelogram in accordance with the principles of this invention.

With a skewed gap in the blanket cylinders 6, 8, the blankets 12, 14 are preferably formed in the form of a parallelogram, FIG. 3, (blanket 12 being shown) in which the opposite interior acute angles b are less than ninety degrees by the degrees of the skew angle a. Alternatively the opposite obtuse angles of the parallelogram exceed ninety degrees by the degrees of the skew angle a. With such construction the ends of the blankets are better received within the slots 16, 18 since there is essentially a uniform amount of blanket material received within the slots 16, 18. The plates 3, 5 are also preferably in the form of a parallelogram with the same relationships as heretofore described with respect to the blankets 12, 14 being employed in plates 3, 5.

Although a presently preferred embodiment of this invention has been described in accordance with the Patent Statutes, it will be realized that various modifications can be made without departing from the spirit and scope of this invention. Specifically, although an offset press has been schematically illustrated and described, the principles of this invention are equally applicable to a direct printing process. Also, although a specific margin length has been described heretofore with reference to a 22¾" by 36" or 38" press the principles of this invention are equally applicable to larger presses such as a 35" by 50" press having 34⅛" of live print. In such a big press the distance D can be substantially larger than that previously described. Also, although an identical skew angle a has been shown and described with relation to cooperable plate and blanket cylinders, it is to be realized that such identical angle is not essential to accomplish the purposes of this invention. For the purposes of this invention it is essential that the width of skew S be equal to or greater than the width of gap G. Preferably the skew width is greater than the gap width; however, the relationship between skew and gap width is established by the length of acceptable non-print margin. It is to be realized that both FIG. 5 and FIG. 7 represent an exaggerated view of the gaps, when if fact, the circumference of the front and rear periphery have centers on a common centerline. Accordingly, this invention is to be construed in accordance with the breadth and scope of the following claims.

I claim:

1. In a printing press having a pair of counterrotating blanket or impression cylinders forming a nip for printing on a traveling web of paper the improvement comprising:

each of said cylinders having an outwardly open blanket receiving gap therein extending the axial length thereof;

blanket members circumferentially encompassing said cylinders, respectively, with the ends thereof extending within said gaps and being secured with respect to said cylinders, respectively;

said gaps being located within a circumferential extent of said cylinders, respectively, with each of said extents being of a preselected circumferential length limited to commercially acceptable practice;

each of said gaps having the ends thereof circumferentially offset from each other with the linear extent of such offset being at least equal to the maximum effective linear width of said gap, said gaps extending in opposite manner in said cylinders, respectively, to pass in criss-crossing relationship when moving through such a nip;

and said gaps extending at angles with respect to an axial extent of the outer surfaces of said cylinders, respectively, to continuously maintain at least the end portions of said cylinders in overlying relationship as said cylinders pass through such a nip and with at least the ends of said gaps passing in non-overlying relationship.

2. In a printing press as defined in claim 1 wherein in addition to said end portions axially inwardly adjacent portions of said cylinders are in overlying relationship.

3. In a printing press as defined in claim 1 wherein said preselected circumferential lengths are essentially equal.

4. In a printing press as defined in claim 1 wherein said gaps are of the same effective linear width.

5. In a printing press as defined in claim 1 wherein said offsets are of the same linear extent.

6. In a printing press as defined in claim 1 wherein said cylinders are identical.

7. In a printing press as defined in claim 4 wherein said offsets are of the same linear extent.

8. In a printing press as defined in claim 4 wherein said preselected circumferential lengths are essentially equal.

9. In a printing press as defined in claim 4 wherein in addition to said end portions axially inwardly portions of said cylinders are in overlying relationship.

10. The method of minimizing streak-producing ringing in a printing press cylinder couple that forms a nip for a traveling web comprising forming outwardly facing gaps extending the lengths of the cylindrical surfaces of the cylinders which gaps are skewed so that when in the nip the two gaps intersect, the skew advance of each gap being greater than the width of that gap by an amount such that the axial length of the region of maximum gap overlap in the nip is less than the lengths of the cylinders thereby to shorten the portions of the cylinders subject to bending in the gap intersect region.

11. The method defined in claim 10 including the additional step of forming the gaps such that the sum of the skew advance and the gap width for each cylinder is no greater than a selected length of non-print area of the web traveling through said nip.

* * * * *